US012167768B2

(12) United States Patent
Mokoski

(10) Patent No.: US 12,167,768 B2
(45) Date of Patent: Dec. 17, 2024

(54) SYSTEM OF MODULAR FOOTWEAR

(71) Applicant: Hannah Mokoski, Amston, CT (US)

(72) Inventor: Hannah Mokoski, Amston, CT (US)

( * ) Notice: Subject to any disclaimer, the term of this patent is extended or adjusted under 35 U.S.C. 154(b) by 232 days.

(21) Appl. No.: 17/236,585

(22) Filed: Apr. 21, 2021

(65) Prior Publication Data

US 2022/0039511 A1 Feb. 10, 2022

Related U.S. Application Data

(60) Provisional application No. 63/062,476, filed on Aug. 7, 2020.

(51) Int. Cl.
*A43B 13/14* (2006.01)
*A43B 3/24* (2006.01)
*A43C 7/00* (2006.01)

(52) U.S. Cl.
CPC ..... *A43B 13/14* (2013.01); *A43B 3/24* (2013.01); *A43B 3/244* (2013.01); *A43C 7/00* (2013.01)

(58) Field of Classification Search
CPC ..... A43B 3/24; A43B 3/242; A43B 3/244
See application file for complete search history.

(56) References Cited

U.S. PATENT DOCUMENTS 4,314,412 A * 2/1982 Anderson ..... A61F 5/0195 36/11.5
5,802,738 A * 9/1998 Ferniani ..... A43B 3/103 36/11.5
6,499,234 B2 * 12/2002 Manzi ..... A43B 3/122 36/15
6,931,766 B2 * 8/2005 Greene ..... A43B 3/122 36/15
7,028,420 B2 * 4/2006 Tonkel ..... A43B 3/12 36/11.5
7,210,251 B1 * 5/2007 Rolle ..... A43B 1/0081 36/15
8,307,570 B2 * 11/2012 Delgatty ..... A43B 13/189 36/15
8,875,417 B2 * 11/2014 Alberi ..... A43B 3/122 36/7.7
9,468,253 B2 * 10/2016 Floriot Godin ..... A43B 13/36
9,468,254 B2 * 10/2016 Chaiken ..... A43B 3/242
9,609,903 B2 * 4/2017 Chavez ..... A43B 3/246
9,808,044 B2 * 11/2017 Teitz ..... A43B 3/12
10,694,806 B2 * 6/2020 Moore ..... A43B 3/242
2002/0124433 A1 * 9/2002 Pan ..... A43B 3/122 36/11.5
2004/0118016 A1 * 6/2004 Tonkel ..... A43B 3/102 36/11.5
2004/0181972 A1 * 9/2004 Csorba ..... A43B 23/0265 36/50.1
2006/0207127 A1 * 9/2006 McGrath ..... A43B 3/242 36/11.5

(Continued)

*Primary Examiner* — Jila M Mohandesi
(74) *Attorney, Agent, or Firm* — CANTOR COLBURN LLP

(57) ABSTRACT

A modular footwear having individual versatility is provided comprising an insole for primary support and a sole provided thereon. The footwear further comprises a heel provided on the insole having a heel counter provided on an upper periphery of the heel and wherein the insole defines a channel for receiving an attachment means to securely attach the footwear to the individual.

19 Claims, 12 Drawing Sheets

(56) References Cited

U.S. PATENT DOCUMENTS

| | | | | |
|---|---|---|---|---|
| 2007/0011910 | A1* | 1/2007 | Keen | A43B 23/07 36/50.1 |
| 2007/0068045 | A1* | 3/2007 | Condie | A43B 23/081 36/77 R |
| 2007/0209235 | A1* | 9/2007 | Brunelle-Wright | A43B 3/122 36/89 |
| 2014/0000126 | A1* | 1/2014 | Nelson-Warren | A43B 5/007 36/100 |
| 2014/0000127 | A1* | 1/2014 | Tang | A43B 3/242 36/25 R |
| 2015/0121723 | A1* | 5/2015 | Duran | A43B 3/0078 36/83 |

* cited by examiner

SYSTEM OF MODULAR FOOTWEAR

CROSS-REFERENCE TO RELATED APPLICATIONS

This application claims the benefit of U.S. Provisional Application No. 63/062,476 filed Aug. 7, 2020, the disclosure of which is incorporated herein by reference in its entirety.

FIELD

The present invention generally relates to footwear, and, more specifically, to modular footwear for customization and versatility based on different needs of the individual.

BACKGROUND

Footwear such as shoes, boots, and the like, is worn by people for a multitude of reasons such as protection against environment, hygiene, and adornment. As such, footwear may be protective, functional, therapeutic, decorative, or a combination thereof. The footwear industry has grown in leaps and bounds, and the growth is ever increasing. Footwear is an important part of the fashion industry and has become a fashion statement for people from all segments. Earlier, people had limited options of footwear. However, in the present times people have wide variety of footwear to choose from.

Currently, different types of footwear are known for catering to different needs of an individual such as for walking, jogging, athletic activities, formal occasions, casual occasions, and the like. These different types of footwear for different needs of individuals pose a problem for the individual in many respects, such as storage, cost, and the like. The problem is further aggravated when the individual has to travel for any reason. The individual is faced with the problem of carrying different types of footwear, which in turn occupy a substantial space of the individual's luggage, thereby significantly increasing weight of the luggage. Further, individuals may possess a variety of footwear, such as different colored shoes, for a single specific purpose, thereby causing another storage problem. Furthermore, requirements of people for footwear vary based on individual choice and taste for footwear. However, it may be difficult for the footwear industry to accommodate the choice and taste of each individual, and, as such people may have to compromise with regard to their choice and taste of the footwear.

Accordingly, a need exists for modular footwear readily adaptable to provide a multitude of options and variety in footwear to an individual without compromising on the choice, taste, and further cost to the individual. Therefore, it is an object of the present invention to obviate the above and other disadvantages from existing art and to provide a modular footwear readily adaptable to provide an efficient solution for different needs of an individual with regards to footwear. It is further an object of the present invention to provide a modular footwear which is comfortable, lightweight, durable, attractive, and has low production cost.

BRIEF DESCRIPTION

According to an embodiment, a modular footwear having individual versatility is provided comprising an insole for primary support and a sole provided thereon. Further, a heel is provided on the insole having a heel counter provided on an upper periphery of the heel and wherein the insole defines a channel for receiving an attachment means to securely attach the footwear to the individual.

According to another embodiment, a modular footwear having individual versatility is provided comprising an insole for primary support and a sole provided thereon. Further, a heel is provided on the insole and a platform provided between the sole and insole to define a groove thereon for receiving a closed toe component, wherein the insole defines multiple channels for receiving an attachment means to securely attach the footwear to the individual.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
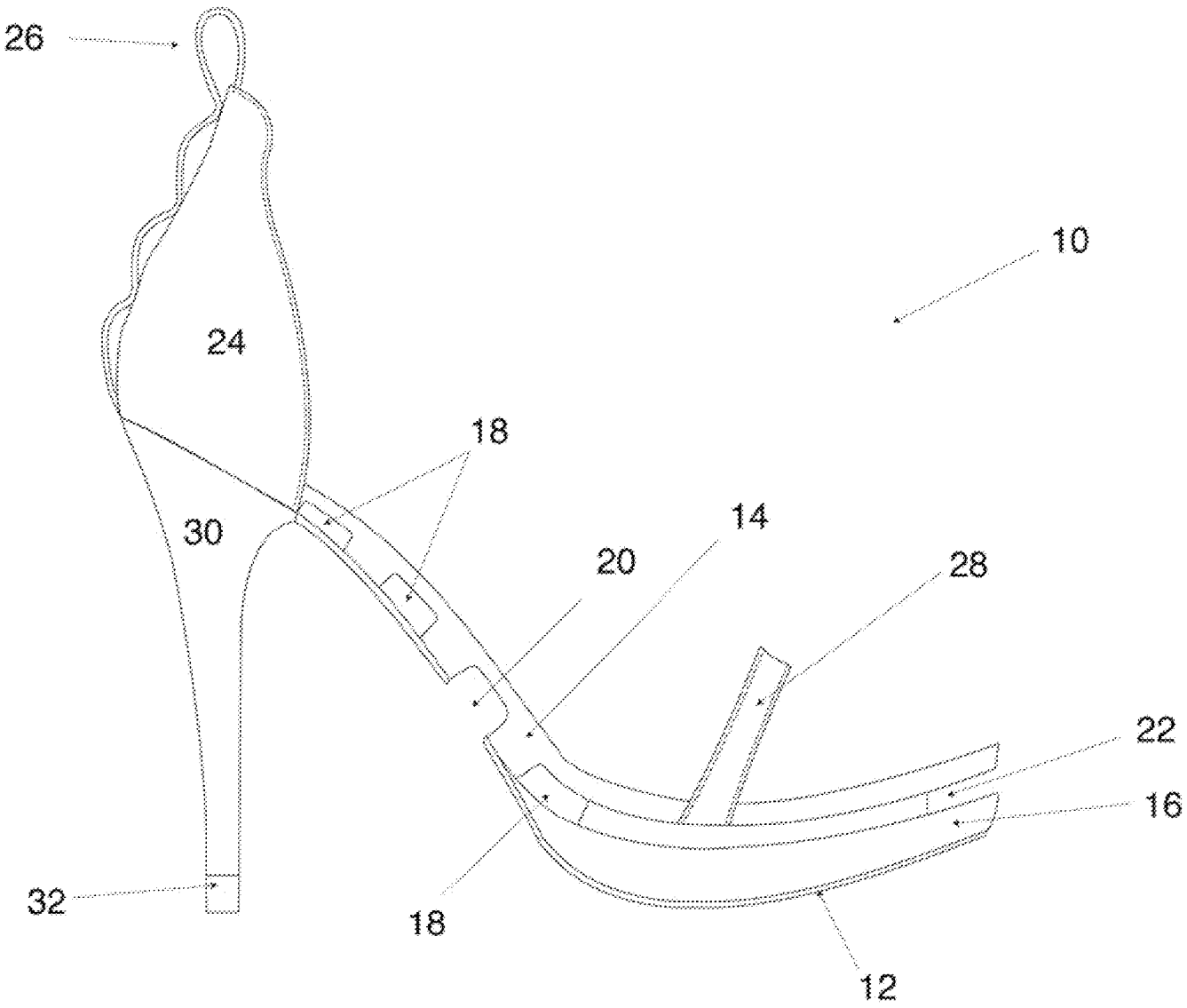
FIG. 1 illustrates an exemplary modular footwear of the present invention.

Referring now to the Figures, there is shown in FIG. 1 a modular footwear 10 of the present invention, including an insole 14 for providing main structural support for the footwear 10. Insole 14 may comprise a shank (not shown) to hold the arch shape in the modular footwear 10 and provide support. Sole 12 provides additional structural support, as well as, enhanced comfort during use. Sole 12 may advantageously comprise an impact resistant material. The footwear may additionally include a heel 30, heel cap 32, as well as, a heel counter 24. The heel 30 is provided on the insole 14. The heel counter 24 may optionally include anchoring loops 26, which may be used as desired with the attachment means (34, 36), as further detailed below. The footwear 10 may also include a fixed toe strap 28.

Advantageously, footwear 10 includes channels 18, 20 further defined by the insole 14. As shown, channels may be in a closed configuration, as in closed channel 18, or in an open configuration as shown in open channel 20. As illustrated, closed channel 18 is further defined at an end or side thereof by a sole 12, thereby requiring the user to thread the attachment means 34, 36 through any of said channels 18. In contrast, open channels 20 are not further structurally defined (or "closed") by a sole 12, thereby allowing the user to wrap the attachment means 34, 36 directly around the insole 14. The size of the channels 18, 20 may be about the same size, or not, depending on application and desired look by the individual. Although the illustrated footwear 10 has four channels 18, 20, it should be understood, the embodiments having any number of channels, such as a single channel, two channels, three channels, or more than our channels, whether open or closed are envisaged within the scope of the invention.

Figure 2:
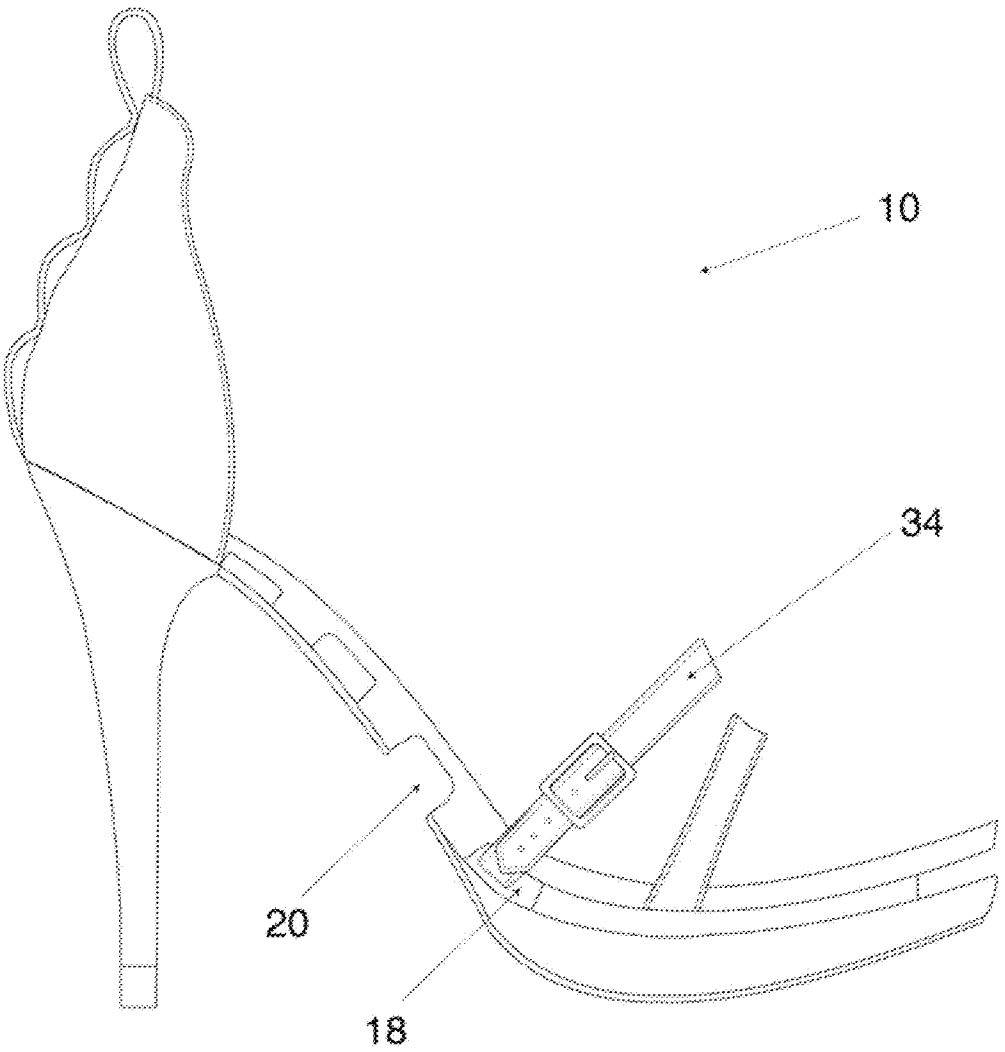
FIG. 2 illustrates an exemplary modular footwear of the present invention having a strap thereon through one of the provided channels.

Referring now to FIG. 2, there is shown a modular footwear 10 having an exemplary attachment means, a single strap 34, provided through a channel 18, for securely attaching the individual/user's foot to the footwear 10. As can be seen, the strap 34 can be secured to any one of the provided channels 18, 20 depending on user preference and personal style. As shown, the strap 34 is threaded through the foremost closed channel 18, closest to the toe of the footwear 10, but can be optionally threaded through any of the other closed channels 18. Alternatively, the single strap 34 may be desirably wrapped around the open channel 20, depending on user preference.

Figure 3:
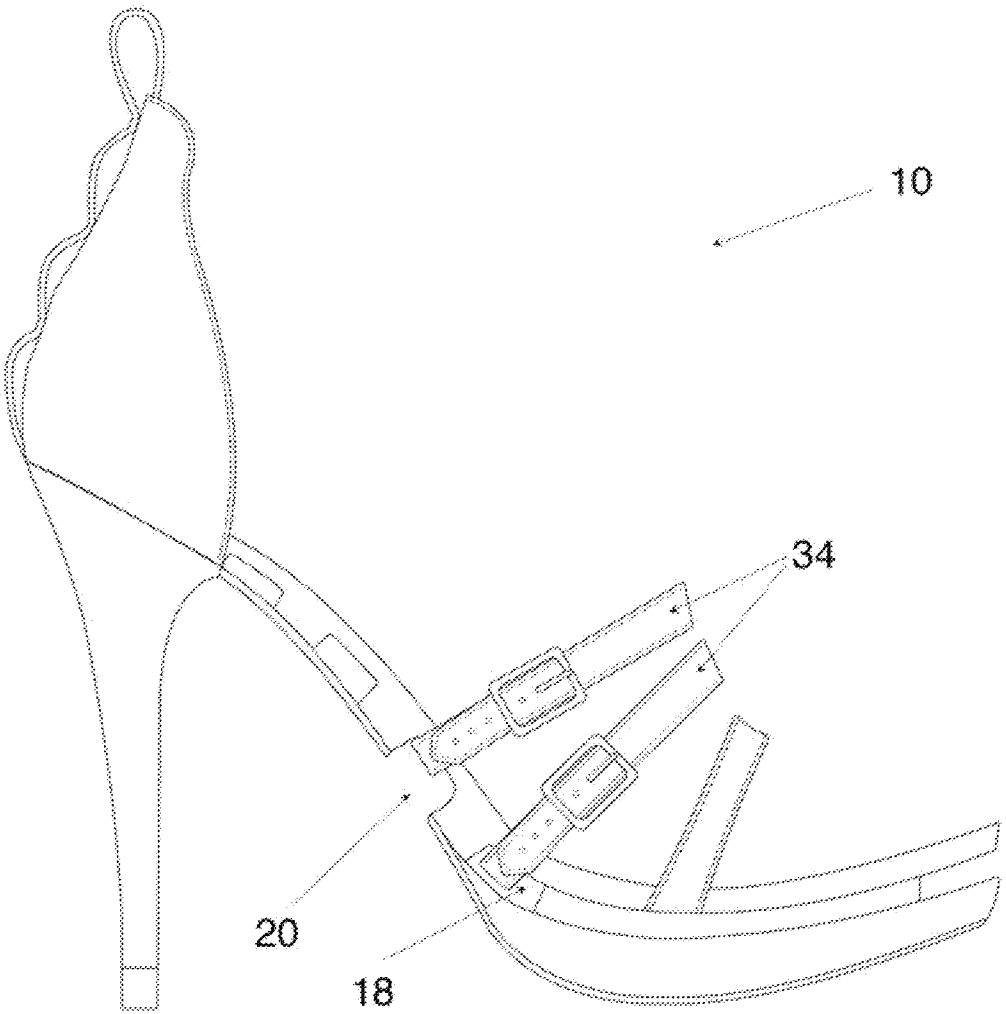
FIG. 3 illustrates an exemplary modular footwear of the present invention having multiple straps thereon through multiple provided channels.

FIG. 3 illustrates yet another embodiment wherein multiple attachments means 34, such as straps for example, are secured to multiple channels, e.g., channels 18, 20. Again, the attachment means 34 can be secured to any one of the provided channels 18, 20 depending on user preferences. In this way, the individual/user decides what combination of attachment means 34 and channels 18, 20 to use with them. Advantageously, the individual can ideally use attachment means readily available and/or already possess. As can be understood, there is potential to create any number of various permutations of the overall look of the modular footwear 10. It should be understood that although each of the attachment means 34 illustrated as being substantially identical, embodiments including a plurality of attachment means 34, 36 having different configurations are also within the scope of the disclosure.

For example, as shown, one of the straps 34 can be threaded through the closed channel 18 while another strap 34 may be optionally wrapped around an open channel 20. Alternatively, for example, both of the straps 34 may be threaded through a closed channel 18. Similarly, one of the straps 34 may be left in the open channel 20, while the other strap 34 is threaded through any one of the other closed channels 18. As can be seen, other embodiments wherein any number (e.g., 3 or 4, etc.) of straps 34 can be threaded/wrapped within the channels 18, 20 of the modular footwear 10 is envisaged within the scope of the invention. As previously noted, the modular footwear 10 may include any number of channels 18, 20 as desired.

Figure 4:
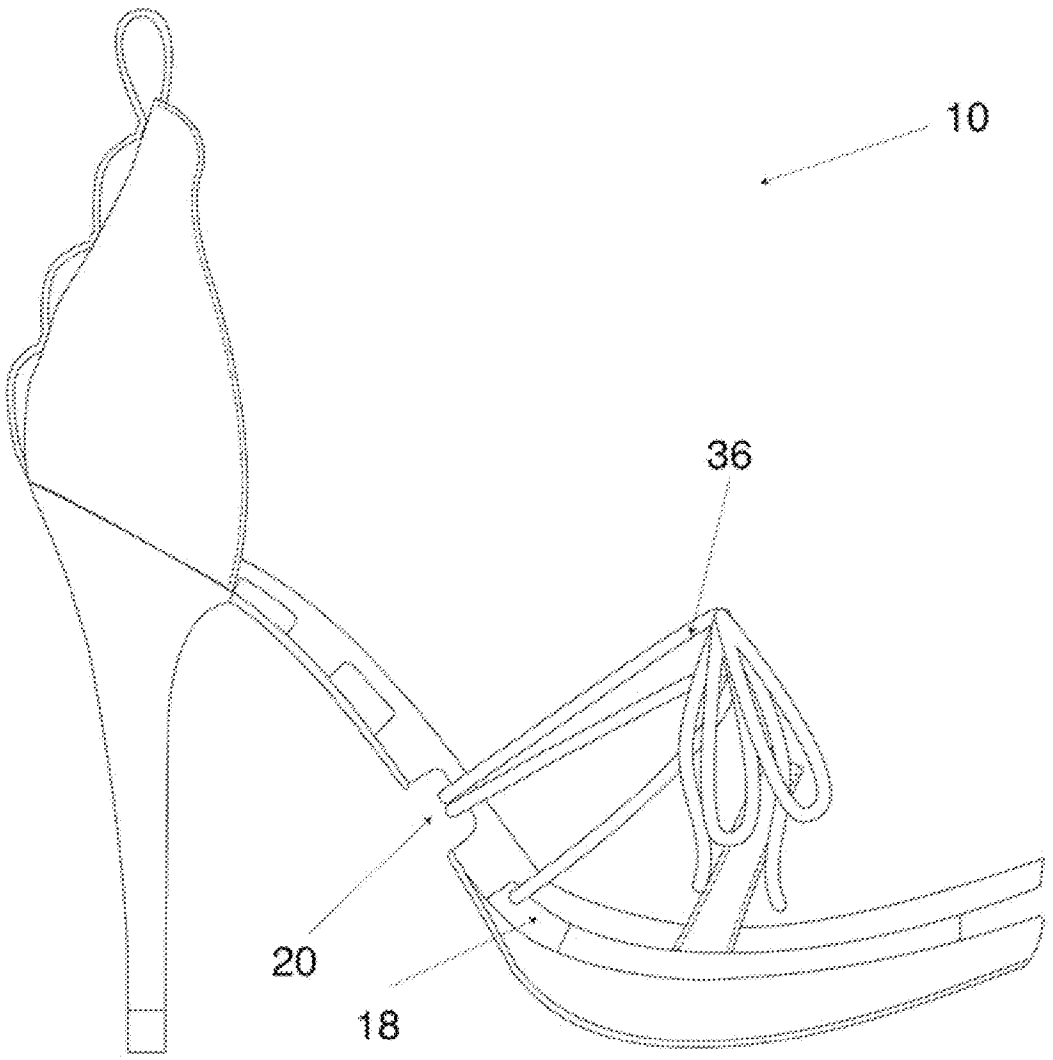
FIG. 4 illustrates an exemplary modular footwear of the present invention having laces thereon through multiple provided channels.

FIG. 4 illustrates yet another embodiment wherein laces 36 are secured to multiple channels, e.g., channels 18, 20. Again, laces 36 can be secured to any one of the provided channels 18, 20 depending on user preferences. In this way, the individual/user decides what combination of laces 36 and channels 18, 20 to use with them. Advantageously, the individual can ideally use attachment means readily available and/or already possess. As can be understood, there is potential to create any number of various permutations of the overall look of the modular footwear 10.

For example, as shown, a single lace 36 can be threaded through the closed channel 18 and further wrapped around open channel 20. Alternatively, for example, the same single lace may be threaded through multiple closed channels 18 only. Similarly, the single lace may be left in the open channel 20, while the remaining part of the single lace 36 is threaded through any of the other available closed channels 18. As can be seen, other embodiments wherein any number (e.g., 2, 3 or 4, etc.) of laces 36 can be threaded/wrapped within the channels 18, 20 of the modular footwear 10 is envisaged within the scope of the invention.

Figure 5:
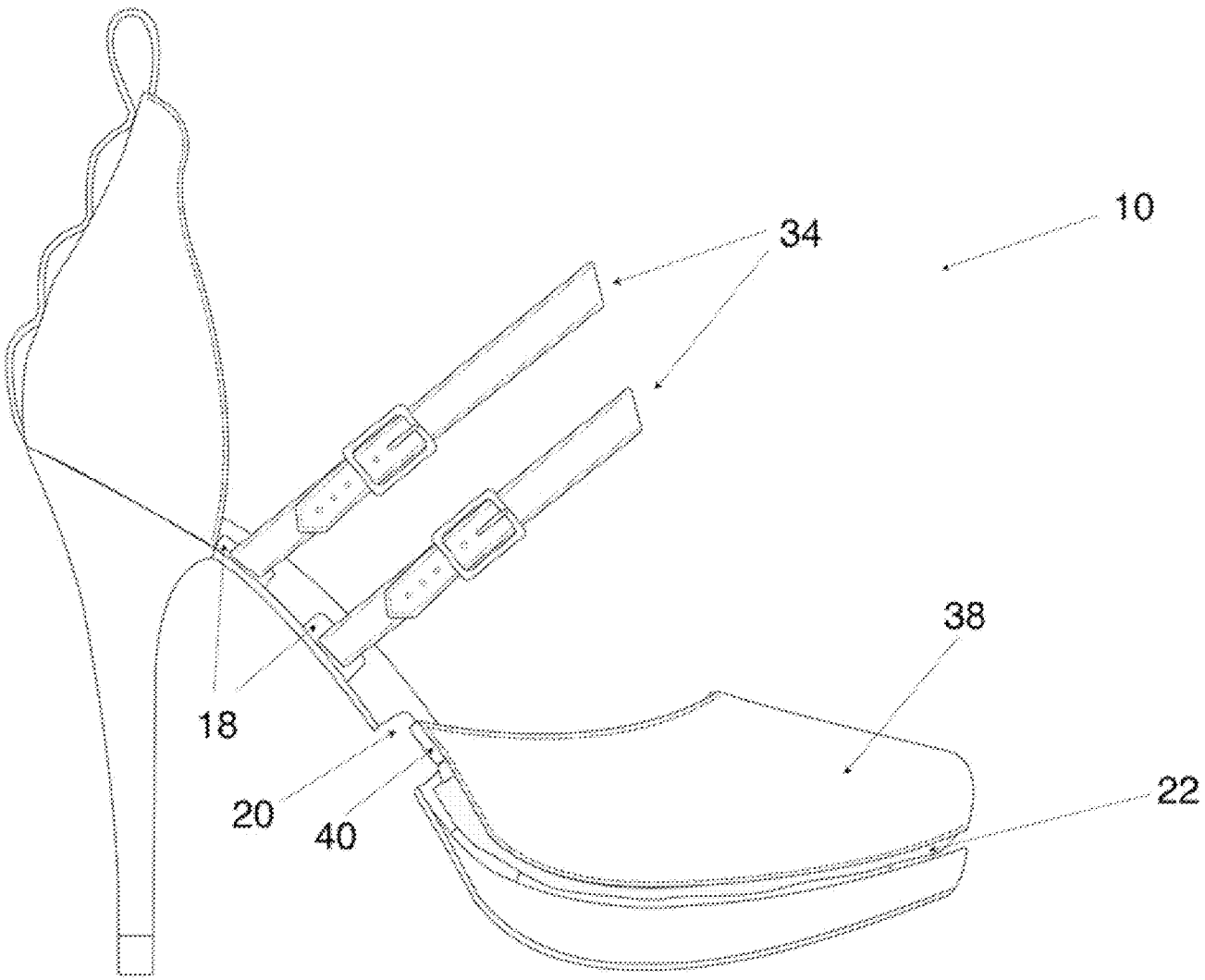
FIG. 5 illustrates an exemplary modular footwear of the present invention having a closed toe component affixed to a groove thereon.

FIG. 5 illustrates yet another embodiment of the footwear 10 wherein a closed toe component 38 is provided. As shown, toe component 38 overlies, and is fitted within the grooves 22 of the modular footwear 10, located on a front end thereof. The grooves 22 are ideally provided within an upper periphery of the platform 16 and a lower end of the insole 14. In an embodiment, the toe component 38 can snugly fit onto the groove 22 and is further secured by a latch 40 that is wrapped around, for example, the open channel 20.

In a further embodiment, the modular footwear 10 of FIG. 5 may further comprise multiple straps 34 that are secured to multiple channels, e.g., channels 18, 20. For example, straps 34 can be secured to any one of the provided closed channels 18 depending on user preferences. In this way, the individual/user decides what combination of multiple straps 34 and channels 18, 20 to use with them. Advantageously, the individual can ideally use attachment means readily available and/or already possess. As can be understood, there is potential to create any number of various permutations of the overall look of the modular footwear 10.

For example, as shown, two of the straps 34 can be threaded through the closed channels 18 while the latch 40 of toe component 38 is wrapped around an open channel 20. Alternatively, for example, only one strap 34 may be threaded through a closed channel 18. As can be seen, other embodiments wherein any number of straps 34 can be threaded/wrapped within any number of the channels 18, 20 of the modular footwear 10 is envisaged within the scope of the invention. As noted, the modular footwear 10 may include any number of channels 18, 20 as desired.

Figure 6:
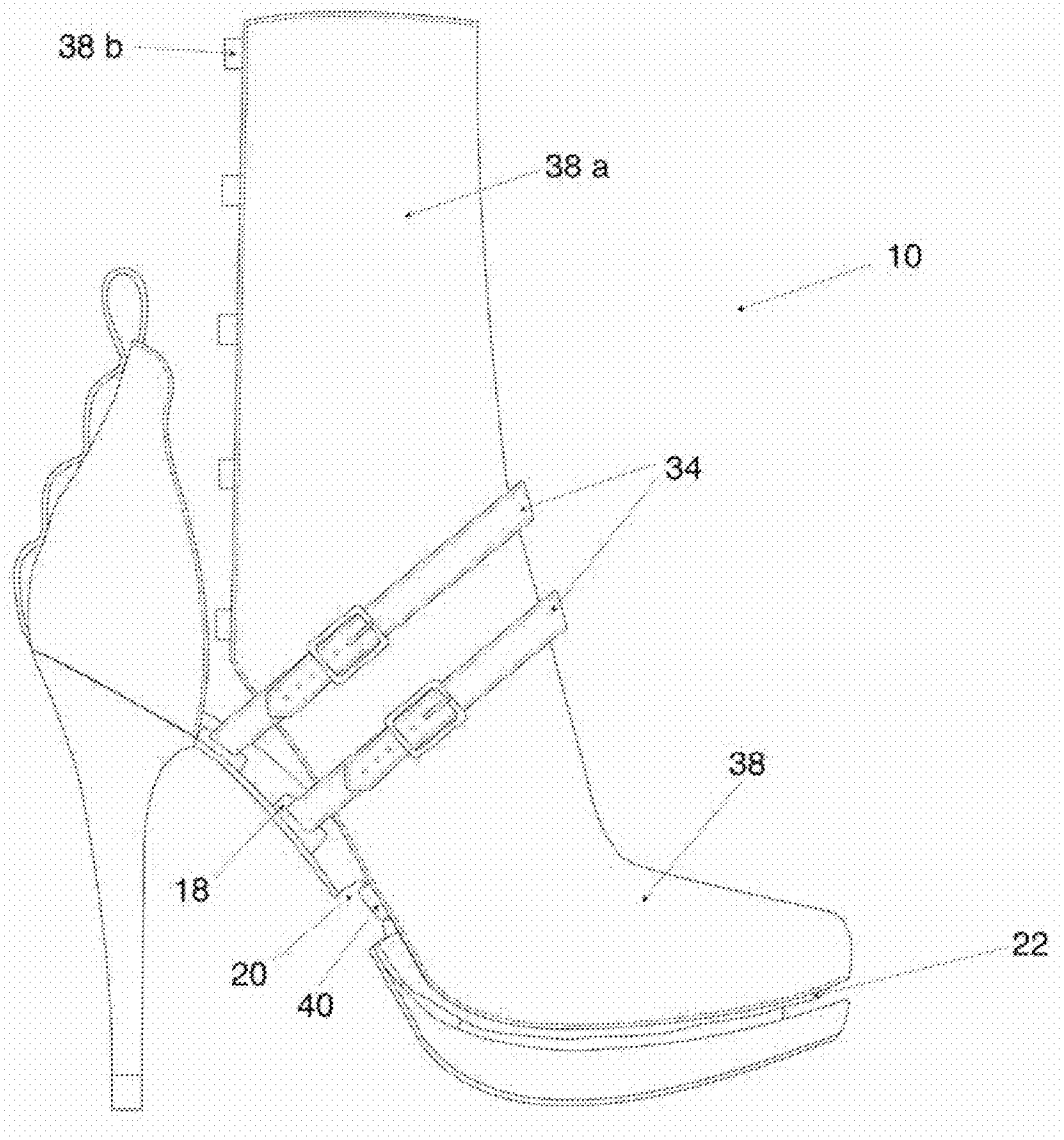
FIG. 6 illustrates an exemplary modular footwear of the present invention having another embodiment closed toe component affixed to a groove thereon.
Figure 7:
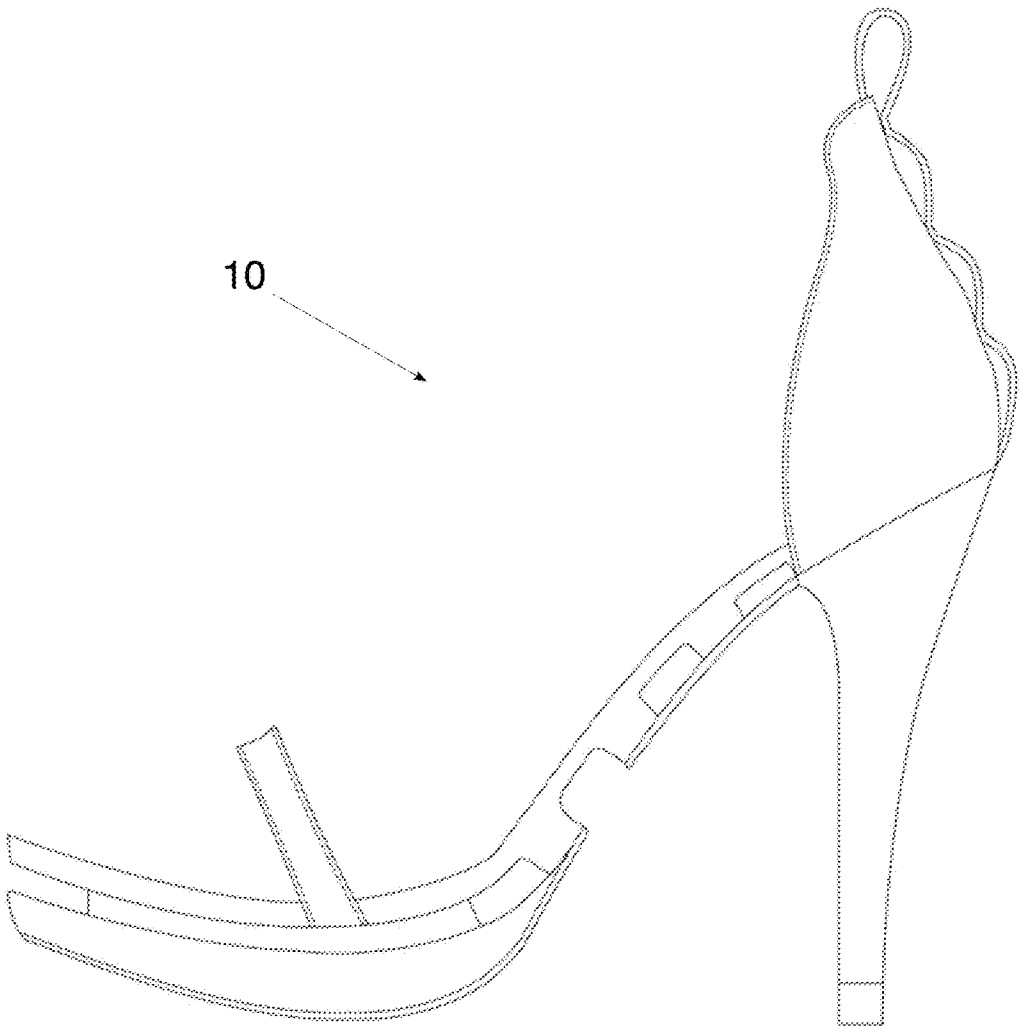
FIG. 7 illustrates a side view of an exemplary modular footwear of the present invention.
Figure 8:
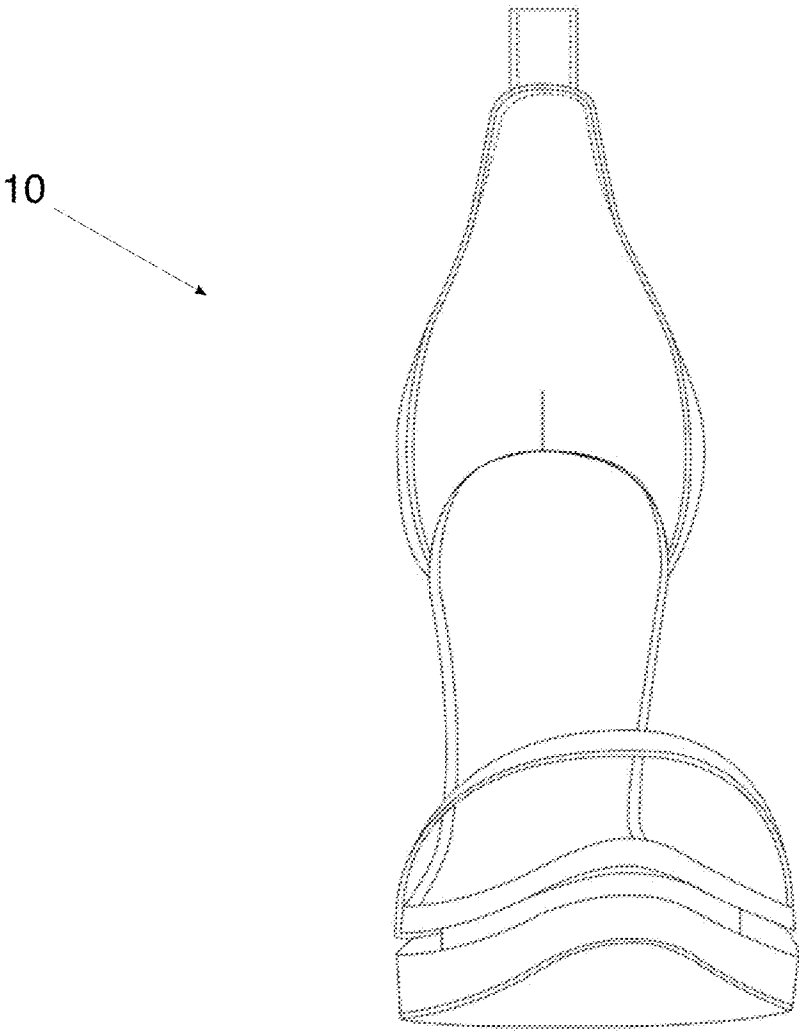
FIG. 8 illustrates a front view of an exemplary modular footwear of the present invention.
Figure 9:
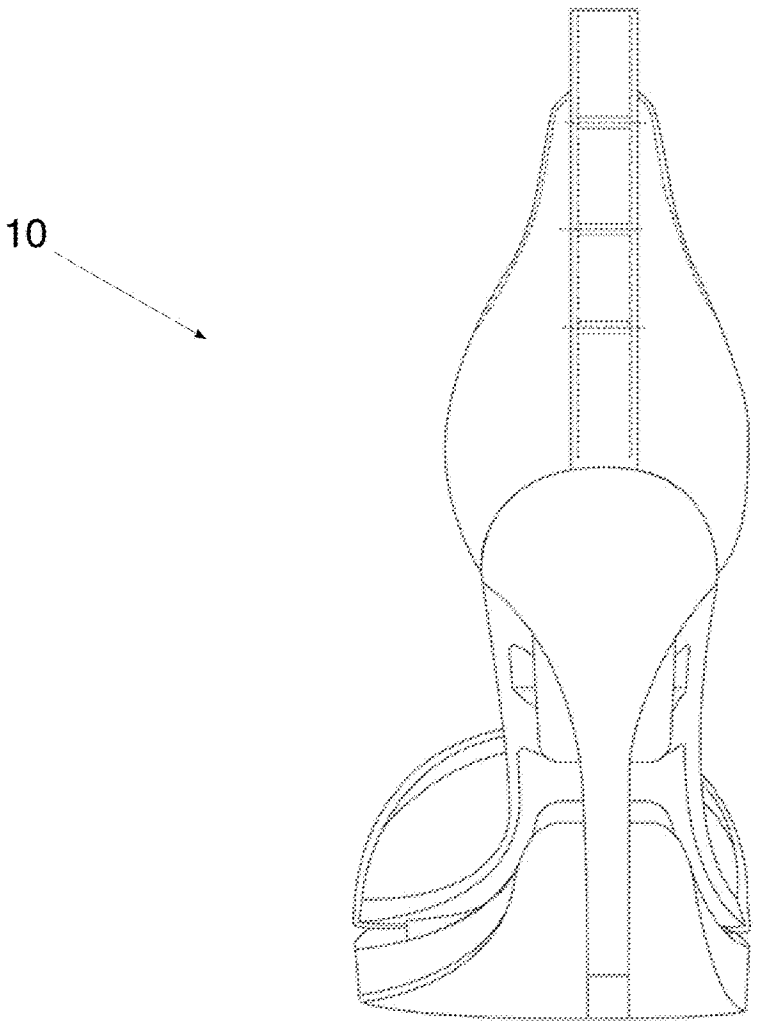
FIG. 9 illustrates a back view of an exemplary modular footwear of the present invention.
Figure 10:
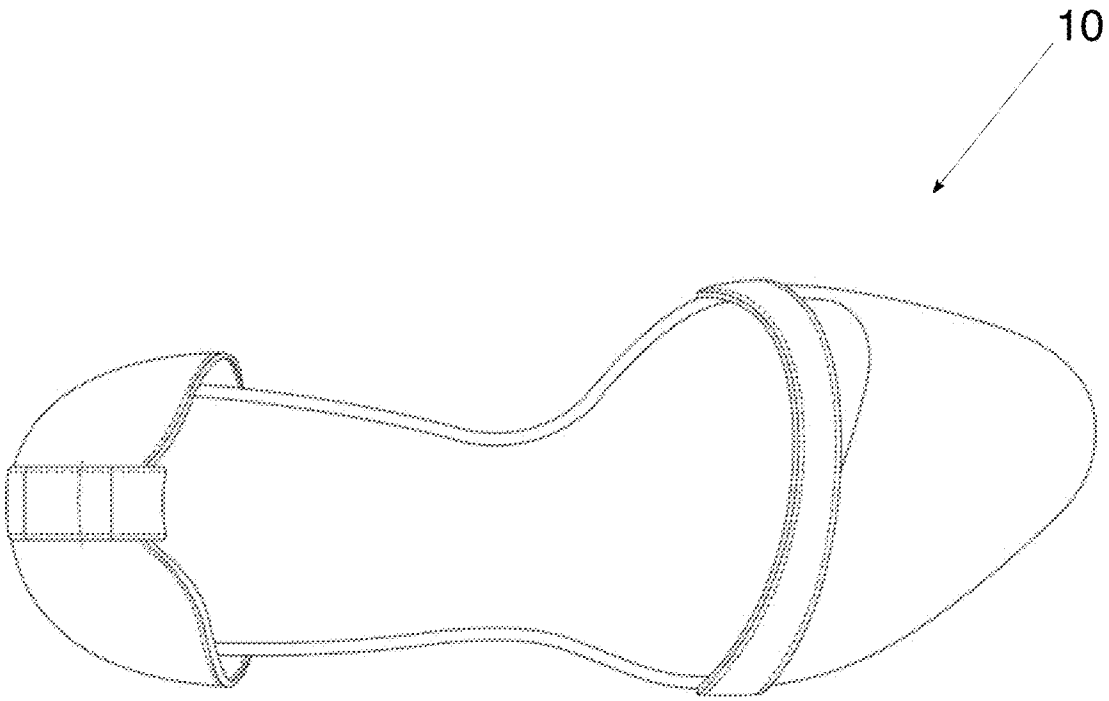
FIG. 10 illustrates a top view of an exemplary modular footwear of the present invention.
Figure 11:
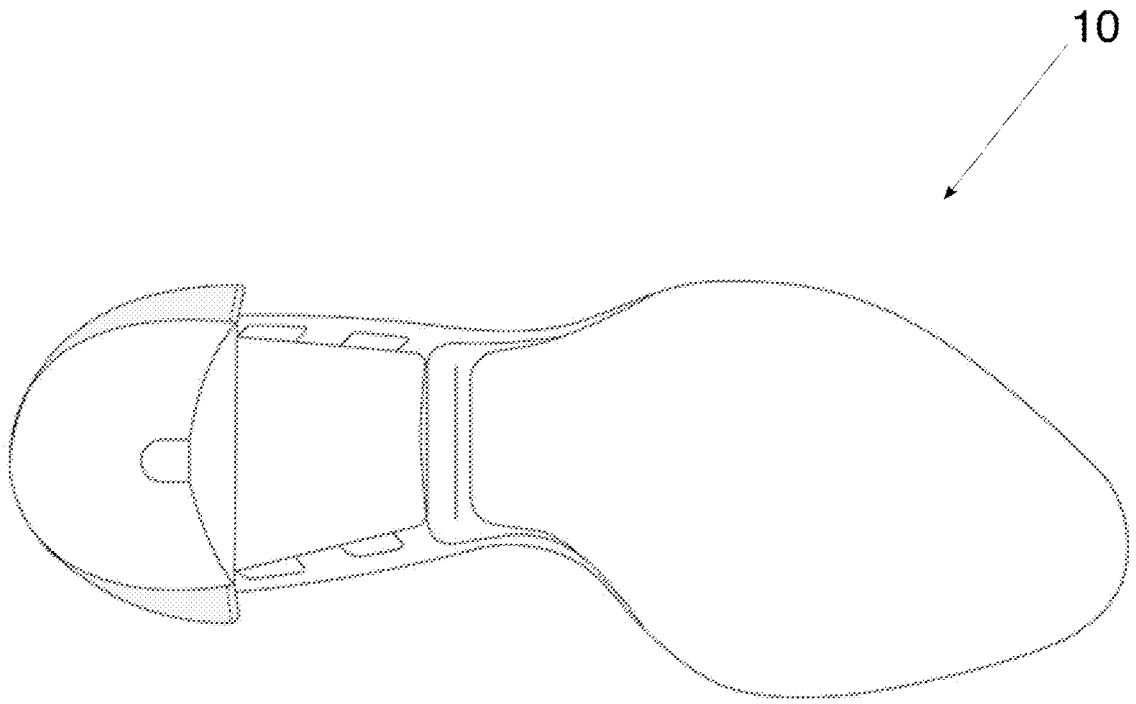
FIG. 11 illustrates a bottom view of an exemplary modular footwear of the present invention.
Figure 12:
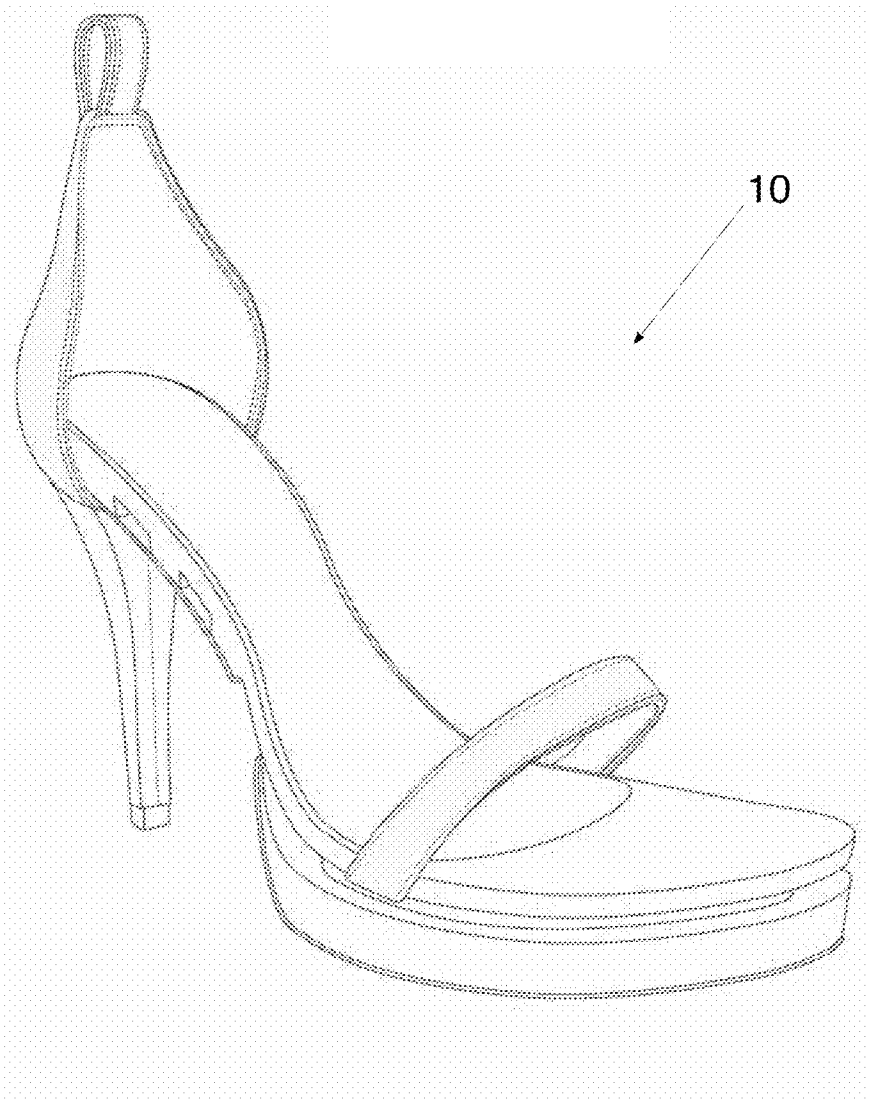
FIG. 12 illustrates a perspective view of an exemplary modular footwear of the present invention.

FIG. 6 illustrates yet another embodiment wherein another variation of a closed toe component 38 having an upper extension **38*a* is provided. Similar to FIG. 5, toe component 38 overlies, and is fitted within the grooves 22 of the modular footwear 10, located on a front end thereof. The grooves 22 are ideally provided within an upper periphery of the platform 16 and a lower end of the insole 14. In an embodiment, the toe component 38 can snugly fit onto the groove 22 and is further secured by a latch 40 that is wrapped around, for example, the open channel 20. Upper extension 38*a* is further provided with tabs 38*b* that can wrap around an upper ankle portion of an individual's leg, further enhancing a look of the modular footwear 10** as desired.

In a further embodiment, the modular footwear 10 of FIG. 6 may further comprise multiple straps 34 that are secured to multiple channels, e.g., channels 18, 20. For example, straps 34 can be secured to any one of the provided closed channels 18 depending on user preferences. In this way, the individual/user decides what combination of multiple straps 34 and channels 18, 20 to use with them. Advantageously, the individual can ideally use attachment means readily available and/or already possess. As can be understood, there is potential to create any number of various permutations of the overall look of the modular footwear 10.

For example, as shown, two of the straps 34 can be threaded through the closed channels 18 while the latch 40 of toe component 38 is wrapped around an open channel 20. Alternatively, for example, only one strap 34 may be threaded through a closed channel 18. As can be seen, other embodiments wherein any number of straps 34 can be threaded/wrapped within any number of the channels 18, 20 of the modular footwear 10 is envisaged within the scope of the invention. As noted, the modular footwear 10 may include any number of channels 18, 20 as desired.

FIGS. 7-12 advantageously provides various other views, including side, front, back, top, bottom and perspective, of the modular footwear 10 of the present invention.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A modular footwear having individual versatility comprising:

an insole for primary support;

a sole provided thereon;

a heel provided on the insole having a heel counter provided on an upper periphery of the heel; and an open channel for receiving an attachment structure to securely attach the footwear to the individual, wherein the open channel is defined in the insole at a location between the sole and the heel, and wherein the open channel is open in a direction facing rearward and downward.

2. The modular footwear of claim 1, further comprising a platform provided between the sole and insole to define a groove thereon for receiving a closed toe component, the groove is open in a direction facing forward and upward.

3. The modular footwear of claim 1, wherein the footwear further comprises multiple closed channels.

4. The modular footwear of claim 3, wherein the footwear comprises multiple attachment structures attached to the multiple channels.

5. The modular footwear of claim 1, wherein the heel counter further comprises anchoring loops.

6. The modular footwear of claim 1, wherein the heel further comprises a heel cap.

7. The modular footwear of claim 1, further comprising a fixed toe strap.

8. The modular footwear of claim 1, wherein the attachment structure is one of a strap and a lace.

9. The modular footwear of claim 1, wherein the open channel is disposed between closed channels.

10. The modular footwear of claim 1, wherein the open channel is disposed forward of a plurality of closed channels.

11. A modular footwear having individual versatility comprising:

an insole for primary support;

a sole provided thereon;

a heel provided on the insole; and a platform provided between the sole and insole to define a groove thereon for receiving a closed toe component, wherein the insole includes an open channel and a closed channel, each of which is configured to receive an attachment structure to securely attach the footwear to the individual, wherein the open and closed channels are defined in the insole at a location between the sole and the heel, wherein the open channel is open in a direction facing rearward and downward, and wherein the groove is open in a direction facing forward and upward.

12. The modular footwear of claim 11, wherein the footwear comprises multiple attachment structures attached to the open and closed channels.

13. The modular footwear of claim 11, further comprising a heel counter provided on an upper periphery of the heel.

14. The modular footwear of claim 11, wherein the heel further comprises a heel cap.

15. The modular footwear of claim 11, wherein the attachment structure is one of a strap and a lace.

16. The modular footwear of claim 11, wherein the open channel is disposed between closed channels.

17. The modular footwear of claim 11, wherein the open channel is disposed forward of a plurality of closed channels.

18. The modular footwear of claim 11, wherein the closed toe component further comprises a latch for further securing said component to said channel.

19. The modular footwear of claim 11, wherein the closed toe component further comprises a tab for further securing said component to the individual.

* * * * *